US011253420B2

(12) United States Patent
Xie

(10) Patent No.: US 11,253,420 B2
(45) Date of Patent: Feb. 22, 2022

(54) DETACHABLE AND INTERCHANGEABLE HAND-AND-FOOT MASSAGER FOR SEPARATE USE

(71) Applicant: Shenzhen Forrest Health Technology Co., Ltd., Guangdong (CN)

(72) Inventor: Xiaogang Xie, Rugao (CN)

(73) Assignee: SHENZHEN FORREST HEALTH TECHNOLOGY CO., LTD., Shenzhen (CN)

( * ) Notice: Subject to any disclaimer, the term of this patent is extended or adjusted under 35 U.S.C. 154(b) by 307 days.

(21) Appl. No.: 16/521,555

(22) Filed: Jul. 24, 2019

(65) Prior Publication Data

US 2020/0222270 A1 Jul. 16, 2020

(30) Foreign Application Priority Data

Jan. 16, 2019 (CN) ..... 201910039767.8

(51) Int. Cl.
*A61H 9/00* (2006.01)
*A61H 7/00* (2006.01)

(52) U.S. Cl.
CPC ... *A61H 9/0092* (2013.01); *A61H 2201/0103* (2013.01); *A61H 2201/0107* (2013.01); (Continued)

(58) Field of Classification Search
CPC ..... A61H 9/00; A61H 9/0007; A61H 9/005; A61H 9/0078; A61H 9/0085; A61H 9/0092; A61H 7/00; A61H 7/001; A61H 7/002; A61H 7/003; A61H 7/004; A61H 7/007; A61H 15/00; A61H 15/0078; A61H 15/0085; A61H 2015/0007; A61H 2015/0028; A61H 2201/0103; A61H 2201/0107; A61H 2201/1207; A61H 2201/0173; A61H 2201/1685; A61H 2201/1238
See application file for complete search history.

(56) References Cited

U.S. PATENT DOCUMENTS 5,241,953 A * 9/1993 Sykes ..... A61H 9/00 601/165
2011/0015553 A1* 1/2011 Chen ..... A61H 23/0263 601/46

(Continued)

*Primary Examiner* — Samchuan C Yao
*Assistant Examiner* — Savannah L Gabriel
(74) *Attorney, Agent, or Firm* — Bayramoglu Law Offices LLC

(57) ABSTRACT

A detachable and interchangeable hand-and-foot massager for separate use includes a main body and a massager, the massager includes a hand massager and a foot massager. The hand massager or the foot massager is detachably mounted on the main body. The main body includes an upper cover of the main body, a base of the main body, an inflation and deflation device, and a massage device for hands and foot. The upper cover of the main body is buckled on the base of the main body, and the upper cover of the main body is provided with an embedded slot. The hand massager or the foot massager includes a massager upper cover, a massager bottom cover and an airbag assembly. The massager bottom cover is provided with a block, and the connector is fixedly mounted in the block. The main body and the massager can freely disassembled and combined.

10 Claims, 4 Drawing Sheets

(52) U.S. Cl.
CPC ..... *A61H 2201/1207* (2013.01); *A61H 2205/065* (2013.01); *A61H 2205/12* (2013.01)

(56) References Cited

U.S. PATENT DOCUMENTS

2015/0173999 A1* 6/2015 Vanderstegen-Drake ..... A61H 9/0092 601/151
2019/0321259 A1* 10/2019 Zhou ..... A61H 9/0078

* cited by examiner

DETACHABLE AND INTERCHANGEABLE HAND-AND-FOOT MASSAGER FOR SEPARATE USE

TECHNICAL FIELD

The present disclosure relates to the field of massager devices, and particularly to a detachable and interchangeable hand-and-foot massager for separate use.

BACKGROUND

The structure of the existing hand massager is mainly composed of an air pump, an electromagnetic valve and an airbag, and the output end of the air pump is connected with the input end of the electromagnetic valve, and the output end of the electromagnetic valve is connected with the air inlet pipeline of the airbag. The air enters into the airbag through the electromagnetic valve when the air pump is started to work, then the airbag bulges and the exhaust port of the electromagnetic valve is opened, so that the air in the airbag is discharged and the airbag contracts. By controlling the pumping frequency of the air pump and the exhaust frequency of the electromagnetic valve, the airbag swells and contracts at a certain frequency and circulates back and forth. The massage experience is achieved by squeezing the hand through the swelling and contracting of the airbag. All parts of this type massager are housed in a single casing, such that the massager can not be freely disassembled and only be used for hand massage.

SUMMARY

The object of the present disclosure is to provide a detachable and interchangeable hand-and-foot massager for separate use for overcoming the defects of the above technical solution effectively. The detachable and interchangeable hand-and-foot massager for separate use are divided into two parts - - - a main body and a massager device, which can be freely disassembled and combined, so that different positions of user can be massaged.

The technical solution of the present disclosure is achieved as following. A detachable and interchangeable hand-and-foot massager for separate use, including a main body and a massager, wherein the massager includes a hand massager and a foot massager, the hand massager or the foot massager is detachably mounted on the main body.

The main body includes an upper cover of the main body, a base of the main body, a inflation and deflation device, and a hand and foot massage device; the upper cover of the main body is buckled on the base of the main body, an embedded slot is provided at a side of the upper cover of the main body facing to the hand massager or the foot massager, and the embedded slot is recessed inwardly. The inflation and deflation device includes a first joint, the first joint is extended from the embedded slot, and the hand and foot massage device is located between the upper cover of the main body and the base of the main body.

The hand massager or the foot massager includes a massager upper cover, a massager bottom cover and an airbag assembly, the massager upper cover is buckled with the massager bottom cover, and the airbag assembly is disposed between the massager upper cover and the massager bottom cover. Each of the airbag assembly and the massager upper cover is provided with an opening, respectively. The airbag assembly is connected with a first air pipeline, and a top end of the first air pipeline is connected with a connector.

One side of the massager bottom cover facing to the main body is provided with a block, and the block is an outwardly protruding block, and the connector is fixedly mounted in the block. When the hand massager or the foot massager is assembled with the main body the block on the massager bottom cover is snapped into the embedded slot of the upper cover of the main body, and the first joint is connected with the connector.

In the structure as described above, the hand and foot massage device includes a motor, a worm, a dual gear, a gear turntable and a thimble massage head.

The motor is fixed on the base of the main body, the worm is fixedly connected to a top of a motor shaft, the dual gear and the gear turntable are rotatably mounted on the base of the main body, an outer side wall of the gear turntable is provided with an external gear; one gear of the dual gear meshes with the worm, and the other gear of the dual gear meshes with the external gear of the gear turntable.

An end surface of the gear turntable is a cam surface which is high and low undulating, an arc surface of a bottom of the thimble massage head is in contact with the end surface of the gear turntable. The upper cover of the main body is provided with a plurality of circular holes, and tops of the thimble massage head extend out from the circular hole.

In the structure as described above, a spring probe is arranged between the upper cover of the main body and the base of the main body, and the spring probe extends into the embedded slot of the upper cover of the main body.

The massager bottom cover is fixed with a conductive contact point, the conductive contact point extends into the block of the massager. When the hand massager or the foot massager is assembled with the main body, the spring probe is in contact with the conductive contact point.

In the structure as described above, the inflation and deflation device includes a battery, an air pump, a second air pipeline, an electromagnetic valve and a main PCB board.

The battery and the air pump are both electrically connected to the main PCB board, and the air pump, the battery and the electromagnetic valve are all fixed on the base of the main body. The electromagnetic valve is provided with an inlet and an outlet, and the inlet is connected with the air pump, and the outlet of the electromagnetic valve is connected to the first joint through the second air pipeline.

In the above structure, the inflation and deflation device further includes a button PCB board, the button PCB board is mounted on the base of the main body. The button PCB board is electrically connected to the main PCB board, the button PCB board is provided with a button panel, and the upper cover of the main body is provided with a corresponding button.

In the above structure, the main base is further provided with a buckle, the hand massager or the foot massager is fixed to the main body by the buckle.

In the above structure the airbag assemble includes an airbag front cover an airbag body, and an airbag bottom cover, the airbag front cover is buckled with the airbag bottom cover to form a receiving cavity, and the airbag body is disposed in the receiving cavity.

In the above structure, the airbag assemble further includes an airbag cover plate and an airbag support plate.

The airbag support plate is fixed on the airbag bottom cover and is located between the airbag bottom cover and the airbag body. The airbag cover plate is attached at the airbag body and is also located between the airbag body and the airbag front cover.

In the above structure, the opening of the hand massager is at the top.

In the above structure, the opening of the foot massager is located on the side wall.

The advantageous effects of the present disclosure are shown as following: when the hand massager is installed, the hand massager is driven by the main body to massage the hand of the human body, and when the foot massager needs to be replaced, the hand massager is directly dismantled, the foot massager is mounted on the main body, so that the foot can be massaged. Therefore, the main body and the massager can be freely disassembled and combined, and one main body can be equipped with a plurality of mass agers to realize multi-functions use in one machine.

DETAILED DESCRIPTION OF THE EMBODIMENTS

The present disclosure will be further described in detail in conjunction with the accompany drawings and embodiments.

Referring FIGS. 1 to 4, a detachable and interchangeable hand-and-foot massager for separate use disclosed in the present disclosure, specifically, includes a main body 10 and a massager. The massager includes a hand massager 30 and a foot massager 20. The hand massager 30 or the foot massager 20 is detachably mounted on the main body 10, in the embodiment described in FIG. 1 and FIG. 2, the massager is the foot massager 20, in the embodiment of FIG. 3, FIG. 4 and FIG. 5, the massager is the hand massager 30. In the two specific embodiments, the structures of the main body 10 are the same, and the difference is only in the hand massager 30 and the foot massager 20, wherein the opening of the hand massager 30 is located at the top, and the opening of the foot massager 20 is located on the side wall, in this embodiment, the hand massager 30 will be described in detail as an example.

Figure 1:
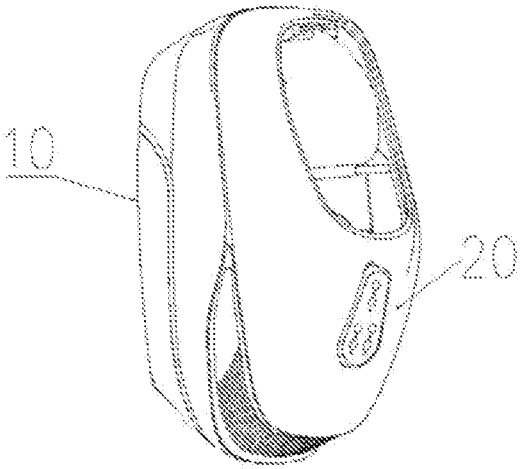
FIG. 1 and FIG. 2 are views showing a first embodiment of a detachable and interchangeable hand-and-foot massager for separate use according to the present disclosure.
Figure 2:
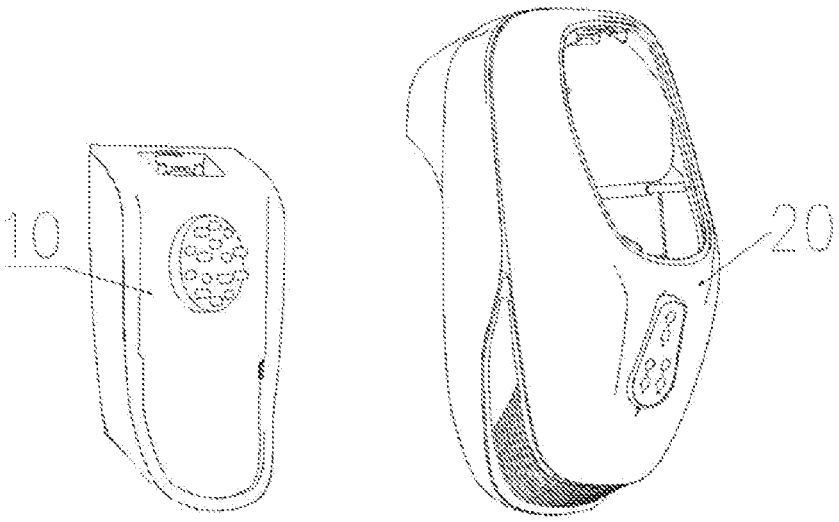
Figure 3:
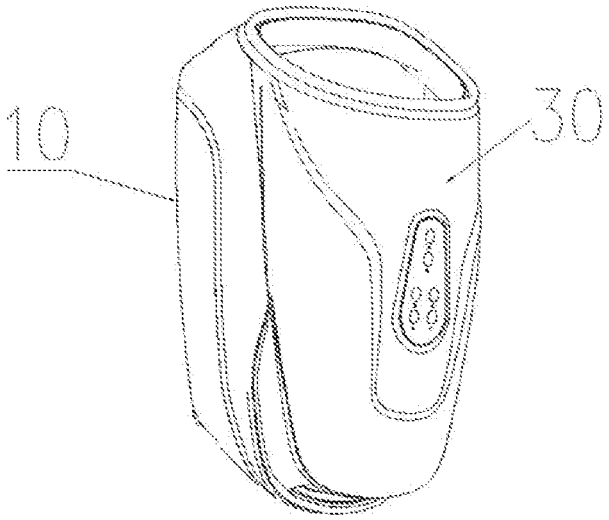
FIG. 3 and FIG. 4 are views showing a second embodiment of the detachable and interchangeable hand-and-foot massager for separate use according to the present disclosure.
Figure 4:
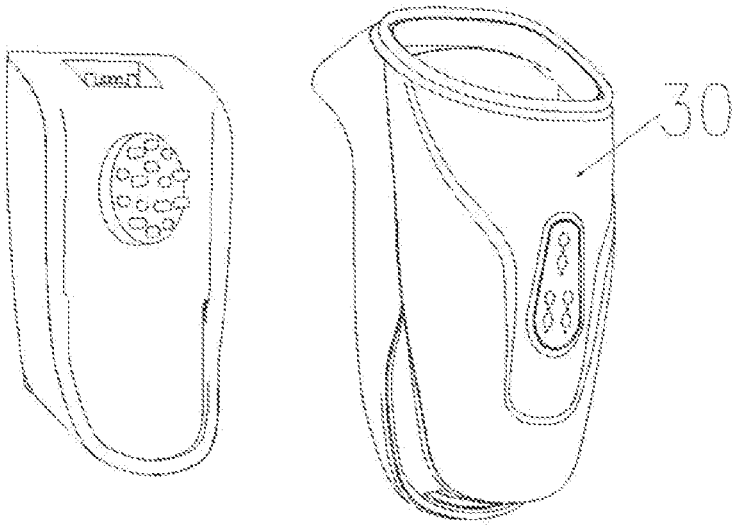
Figure 5:
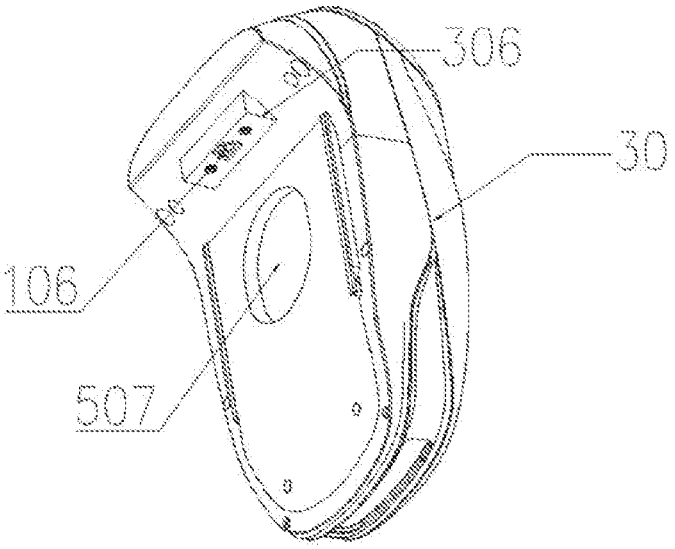
FIG. 5 is a structural schematic view of a foot massager of the detachable and interchangeable hand-and-foot massager for separate use according to the present disclosure.
Figure 6:
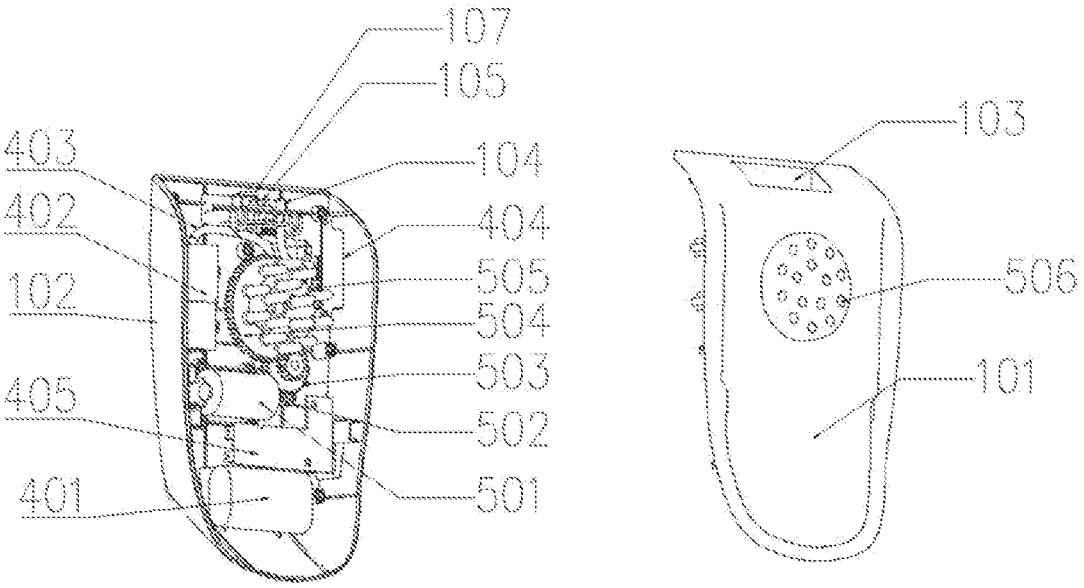
FIG. 6 is art exploded view showing a main body of the detachable and interchangeable hand-and-foot massager for separate use according to the present disclosure.
Figure 7:
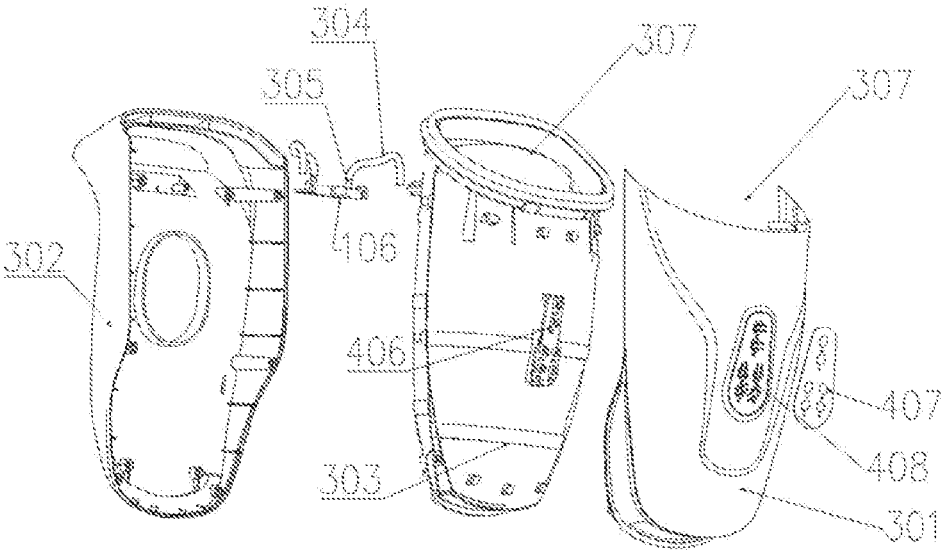
FIG. 7 is an exploded view showing a hand massager of the detachable and interchangeable hand-and-foot massager for separate use according to the present disclosure.

In the above embodiment, as shown in FIG. 6, the main body 10 includes an upper cover of the maim body 101, a base of the main body 102, and a inflation and deflation device. The upper cover of the maim body 101 is buckled with the base of the main body 102, and the side of the upper cover of the maim body 101 facing to the hand massager 20 or the foot massager 30 is provided with an embedded slot 103, wherein the embedded slot 103 is recessed inwardly. The inflation and deflation device includes a first joint 104, wherein the first joint 104 extends out from the embedded slot 103. As shown in FIG. 7, the hand massager 30 includes a massager upper cover 301, a massager bottom cover 302, and an airbag assembly 303. The massager upper cover 301 is buckled with the massager bottom cover 302. The assembly 303 is disposed between the massager upper cover 301 and the massager bottom cover 302, and the airbag assembly 303 and the massager upper cover 301 are provided with an opening 307, respectively. The airbag assembly 303 is connected with a first air pipeline 304, and the top end of the first air pipeline 304 is connected to a connector 305. As shown in FIG. 5, a block is disposed on the side of the massager bottom cover 302 facing to the main body 10, wherein the block is an outwardly protruding block. The connector 305 is fixedly mounted in the block 306. When the foot massager 30 is assembled with the main body 10, the block 306 on the massager bottom cover 302 is snapped into the embedded slot 103 of the upper cover 101 of the main body, and the first joint 104 is connected with the connector 305.

Further, in the above embodiment, a spring probe 105 is disposed between the upper cover of the main body 101 and the base of the main body 102. The spring probe 105 extends into the embedded slot 103 of the upper cover of the main body 101. The massager bottom cover 302 is also fixedly provided with a conductive contact point 06, and the conductive contact point 106 extend into the block 306 of the massager. When the foot massager 20 or the hand massager 30 is assembled with the main body 10, the spring probe 105 is in contact with the conductive contact point The contact of the spring probe 105 with the conductive contact point 106 generates a signal, and the massager can only be normally activated in the presence of the signal, so as to improve the safety of the massager.

The base of the main body 102 is further provided with a buckle 107, and the hand massager 20 or the foot massager 30 is fixed on the main body 10 by the buckle 107. When the foot massager 20 is installed, the foot massager 20 is driven to massage the foot of the human body by the driving of the main body 10. The foot massager 20 is directly removed when the hand massager 30 needs to be replaced, by installing the hand massager 30 to the main body 10, the hand massage can perform massage on the hand of the human body. Therefore, the main body 10 and the massager can be freely disassembled and combined, and one main body 10 can be equipped with a plurality of mass agers to realize multi-functions use in one machine.

The main body further includes a hand and foot massage device. As shown in FIG. 6, the hand and foot massage device is located between the upper cover of the mam body and the base of the main body. The hand and foot massage device includes a motor 501, a worm 502, a dual gear 503, a gear turntable 504 and the thimble massage head 505. The motor 501 is fixed on the base of the main body 102, the worm 502 is fixedly connected to the top of the motor shaft, and the dual gear 503 and the gear turntable 504 are rotatably mounted on the base of the main body 102, and an outer gear is disposed on an outer sidewall of the gear turntable 504. One gear of the dual gear 503 meshes with the worm 502, and the other gear of the dual gear 503 meshes with an outer gear of the gear turntable 504. The end surface of the gear turntable 504 is a cam surface which is high and low undulating, and the arc surface of the bottom of the thimble massage head 505 is in contact with the end surface of the gear turntable 504. The upper cover of the main body 101 is provided with a plurality of circular holes, and tops of the thimble massage head 505 extend out from the circular holes. The motor 501 is rotated to drive the worm 502, the dual gear 503, and the gear turntable 504 to rotate. The thimble massage head 505 is inserted into the circular hole 506 and can slide up and down. In this embodiment, there are 15 thimble massage heads 505 in total, and the thimble massage heads 505 which are in contact with the protruding portion of the gear turntable 504 are jacked up, and the thimble massage heads 505 which are in contact with the recess of the gear turntable 504 is dropped. When the hand massager 30 or the foot massager 20 is assembled with the mam body 10, the 15 thimble massage heads are inserted into the bottom opening 507 of the massager, and is in contact with the palm of the human body or the sole of the foot. When the gear turntable is rotated, the 15 thimble massage heads are jacked up and down in turn, circulating back and forth, and the massage experience is obtained when the jacking up thimble massage head hits the palm or the sole.

For the inflation and deflation device, as shown in FIG. 6, the present disclosure provides a specific embodiment. The inflation and deflation device includes a battery 401, an air pump 402, a second air pipeline 403, an electromagnetic valve 404, and a main PCB board 405. The battery 401 and the air pump 402 are electrically connected to the main PCB board 405. The air pump 402, the battery 401 and the electromagnetic valve 404 are all fixed on the base of the main body 102. The electromagnetic valve 404 is provided with an inlet and an outlet. The inlet is connected to the air pump 402, and the outlet of the electromagnetic valve 404 is connected to the first joint 104 through the second air pipeline 403. In addition, the inflation and deflation device further includes a button PCB board 406. The button PCB board 406 is mounted on the airbag front cover 3031. The button PCB board 406 is electrically connected to the conductive contact point 106. The button PCB board 406 is provided with a button, and a button panel 407 is disposed on the button PCB board 406. The button panel 407 is attached to the massager upper cover 301, and a button 408 is disposed corresponding to the button on the PCB board 406.

After the hand massager 30 or the foot massager 20 is assembled with the main body 10, the signal generated by the contact of the spring probe 105 with the conductive contact point 106 is sent to the main PCB board 405, and the main PCB board 405 is in the standby state. The main body 10 is controlled by the button panel 407. When the air pump 402 is turned on, the air enters the second air pipeline 403 via the electromagnetic valve 404, and the air is transported to the first air pipeline 304 through the connection of the first joint 104 and the connector 305, and enters into the airbag assembly 303, so that the airbag assembly is bulged. The exhaust port of the electromagnetic valve 404 is opened, the air in the airbag assembly 303 is exhausted, the airbag is contracted. By controlling the frequency of the air pump 402 and the exhaust frequency of the electromagnetic valve 404, the airbag assembly 303 is bulged and contracted at a certain frequency and circulates back and forth, and the airbag assembly 303 is to press the relevant part of the human body to obtain a massage experience.

Figure 8:
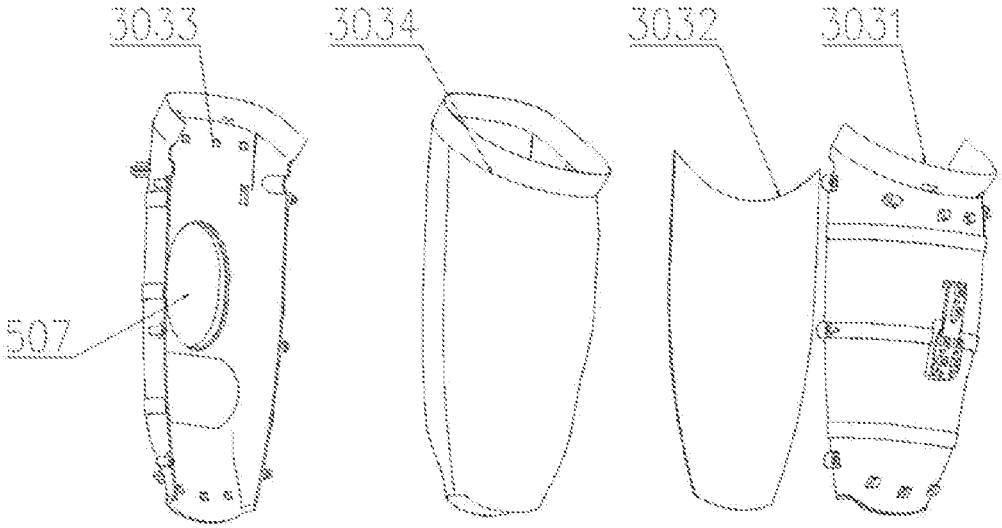
FIG. 8 is an exploded view of a hand airbag assembly of the detachable and interchangeable hand-and-foot massager for separate use according to the present disclosure.

As shown in FIG. 8, for the airbag assemble 303, the present disclosure provides a specific embodiment. The airbag assemble 303 includes an airbag front cover 3031, an airbag body 3032, and an airbag bottom cover 3033. The airbag front cover 3031 and the airbag bottom cover 3033 are buckled with each other to form an receiving cavity, and the airbag body 3032 is disposed in the receiving cavity. In addition, the airbag assembly 303 further includes an airbag elastic cloth cover 3034. The airbag body 3032 is attached at the airbag elastic cloth cover 3034. The airbag elastic cloth cover 3034 is fixed in the interior of the airbag bottom cover 3033 and the airbag front cover 3031. This structure of the airbag assemble 303 is a stable structure, due to the presence of the airbag elastic cloth cover 3034, the airbag body 3032 can be returned to the original state after deflation, thereby improving the user experience and the service life of the product.

The above description is only the preferred embodiment of the present disclosure, and the above specific embodiments are not intended to limit the present disclosure. Various modifications and changes may be made within the technical solution concept of the present disclosure, and any modifications, changes or equivalent replacement made by the ordinary skilled person in the art according to the above description are within the scope of the present disclosure.

What is claimed is:

1. A detachable and interchangeable hand-and-foot massager, comprising a main body and a massager, wherein the massager comprises a hand massager and a foot massager, the hand massager or the foot massager is detachably mounted on the main body;

the main body comprises an upper cover of the main body, a base of the main body, an inflation and deflation device and a percussive hand and foot massage device; the upper cover of the main body is coupled to the base of the main body; an embedded slot is provided at a side of the upper cover of the main body facing to the hand massager or the foot massager, and the embedded slot is recessed inwardly; the inflation and deflation device comprises a first joint, the first joint is extended from the embedded slot, and the percussive hand and foot massage device is located between the upper cover of the main body and the base of the main body;

the hand massager or the foot massager comprises a massager upper cover, a massager bottom cover and an airbag assembly, wherein the massager upper cover is coupled with the massager bottom cover, and the airbag assembly is disposed between the massager upper cover and the massager bottom cover; each of the airbag assembly and the massager upper cover is provided with an opening;

the airbag assembly is connected with a first air pipeline, and a top end of the first air pipeline is connected with a connector;

one side of the massager bottom cover facing to the main body is provided with a block, and the block is an outwardly protruding block, and the connector is fixedly mounted in the block; when the hand massager or the foot massager is assembled with the main body, the block on the massager bottom cover is snapped into the embedded slot of the upper cover of the main body, and the first joint is connected with the connector.

2. The detachable and interchangeable hand-and-foot massager according to claim 1, wherein the percussive hand and foot massage device comprises a motor, a worm, a dual gear, a gear turntable and a thimble massage head;

the motor is fixed on the base of the main body, the worm is fixedly connected to a top of a motor shaft, the dual gear and the gear turntable are rotatably mounted 011 the base of the main body, an outer side wall of the gear turntable is provided with an external gear; one gear of the dual gear meshes with the worm, and the other gear of the dual gear meshes with the external gear of the gear turntable;

an end surface of the gear turntable is a cam surface which is high and low undulating, an arc surface of a bottom of the thimble massage head is in contact with the end surface of the gear turntable; the upper cover of the main body is provided with a plurality of circular holes, and tops of the thimble massage heads extend out from the circular holes.

3. The detachable and interchangeable hand-and-foot massager according to claim 1, wherein a spring probe is arranged between the upper cover of the main body and the base of the main body, and the spring probe extends into the embedded slot of the upper cover of the main body, the massager bottom cover is fixed with a conductive contact point, the conductive contact point extends into the block of the massager; when the hand massager or the foot massager is assembled with the main body, the spring probe is in contact with the conductive contact point.

4. The detachable and interchangeable hand-and-foot massager according to claim 1, wherein the inflation and deflation device comprises a battery, an air pump, a second air pipeline, an electromagnetic valve and a main PCB board;

the battery and the air pump are both electrically connected to the main PCB board, and the air pump, the battery and the electromagnetic valve are all fixed on the base of the main body; the electromagnetic valve is provided with an inlet and an outlet, and the inlet is connected with the air pump, and the outlet of the electromagnetic valve is connected to the first joint through the second air pipeline.

5. The detachable and interchangeable hand-and-foot massager according to claim 4, wherein the inflation and deflation device further comprises a button PCB board, the button PCB board is mounted on a front cover of the airbag; the button PCB board is electrically connected to the conductive contact point; the button PCB board is provided with a button, and the massager upper cover is provided with a corresponding button.

6. The detachable and interchangeable hand-and-foot massager according to claim 1, wherein the airbag assembly comprises an airbag front cover, an airbag body, and an airbag bottom cover, the airbag front cover is coupled with the airbag bottom cover to form a receiving cavity, and the airbag body is disposed in the receiving cavity.

7. The detachable and interchangeable hand-and-foot massager according to claim 6, wherein the airbag assemble further comprises an airbag elastic cloth cover;

the airbag elastic cloth cover is fixed in an interior of the airbag front cover and the airbag bottom cover, and the airbag body is attached to the airbag elastic cloth cover and is located between the airbag bottom cover and the airbag upper cover.

8. The detachable and interchangeable hand-and-foot massager according to claim 1, wherein the opening of the hand massager is at a top of the hand massager.

9. The detachable and interchangeable hand-and-foot massager according to claim 1, wherein the opening of the foot massager is located on a side wall of the foot massager.

10. The detachable and interchangeable hand-and-foot massager according to claim 1, wherein the base of the main body is further provided with a buckle, and the hand massager or the foot massager is fixed to the main body by the buckle.

* * * * *